US006655212B2

(12) United States Patent
Ohta

(10) Patent No.: US 6,655,212 B2
(45) Date of Patent: Dec. 2, 2003

(54) SOUND FIELD MEASURING APPARATUS AND METHOD

(75) Inventor: Yoshiki Ohta, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/983,254

(22) Filed: Oct. 23, 2001

(65) Prior Publication Data

US 2002/0062695 A1 May 30, 2002

(30) Foreign Application Priority Data

Oct. 23, 2000 (JP) ..... P. 2000-322753

(51) Int. Cl.[7] ..... H04R 1/28

(52) U.S. Cl. ..... 73/586; 73/646; 381/98; 381/94.3

(58) Field of Search ..... 73/586, 597, 599, 73/602, 645, 646; 381/94.3, 98, 99, 66, 97

(56) References Cited

U.S. PATENT DOCUMENTS 4,209,672 A * 6/1980 Nitta et al. ..... 381/59
4,888,808 A * 12/1989 Ishikawa et al. ..... 381/103
5,128,999 A * 7/1992 Yanagawa ..... 381/22
5,572,443 A * 11/1996 Emoto et al. ..... 702/103
5,742,688 A * 4/1998 Ogawa et al. ..... 381/17
6,477,255 B1 * 11/2002 Yoshida et al. ..... 381/86
2001/0016045 A1 * 8/2001 Ohta ..... 381/98

FOREIGN PATENT DOCUMENTS

JP Hei 6-13292 * 2/1994

* cited by examiner

*Primary Examiner*—Hezron Williams
*Assistant Examiner*—Rose M. Miller
(74) *Attorney, Agent, or Firm*—Sughrue Mion, PLLC

(57) ABSTRACT

A sound field measuring apparatus has: an exponential pulse generator 11 which outputs a pulse signal to speakers 4*a*, 4*b*, . . . ; a microphone 6 which is disposed in an acoustic space 5 where the speakers 4*a*, 4*b*, . . . are disposed, and which detects a pulse signal output from each of the speakers 4*a*, 4*b*, . . . ; and a calculation section 15 which detects a time when the signal detected by the microphone 6 exceeds a predetermined threshold. The calculation section 15 calculates a time period from a time when the pulse signal is generated by the exponential pulse generator 11 to the time when the signal exceeds the predetermined threshold.

38 Claims, 5 Drawing Sheets

SOUND FIELD MEASURING APPARATUS AND METHOD

BACKGROUND OF THE INVENTION

1. Field of the Invention

The present invention relates to a sound field measuring apparatus and a sound field measuring method which are useful for, in an audio system having a plurality of speakers, correcting output signals for the speakers.

2. Description of the Related Art

In a conventional audio system having a plurality of speakers, it is preferable that a reproduced sound image is localized at a predetermined position and the sound field is correctly reproduced. Therefore, it is required to correctly know the time of arrival from each of the speakers to the listener. Conventionally, an impulse signal is used as means for measuring the time of arrival.

The time of arrival is measured by using an impulse signal in the following manner. An impulse signal is output from a speaker. The signal is detected by a microphone disposed at a predetermined position (listening position), and an impulse response between the speaker and the microphone (listener) is calculated. In this specification, the time of arrival means a time period from a time when an impulse response is input, to that when an impulse response reaches the maximum peak value.

In the above-mentioned measuring method, however, it is difficult to correctly calculate the rising time of the speaker which indicates a response concentrated into a low-frequency region. When a speaker of a moderate response is used, the rising time cannot be correctly determined. Depending on conditions of installing the speaker and the like, a case where background noises or indirect sound components are larger than direct sound components may sometimes occur. In such a case, it is impossible to correctly perform the time measurement.

SUMMARY OF THE INVENTION

It is an object of the invention to provide a sound field measuring apparatus which can correctly determine the rising time of a speaker.

The sound field measuring apparatus of the invention comprises: a pulse signal generating section (11, and the like) for outputting a pulse signal to speakers (4*a*, 4*b*, . . . ); a pulse signal detecting section (6, and the like) disposed in an acoustic space (5) where the speakers (4*a*, 4*b*, . . . ) are placed and for detecting a pulse signal output from each of the speakers (4*a*, 4*b*, . . . ); a time detecting section (15) for detecting a time when the signal detected by the pulse signal detecting section (6, and the like) exceeds a predetermined threshold; and a calculating section (15) for calculating a time period from a time when the pulse signal is generated by the pulse signal generating section (11, and the like) to a time of detection by the time detecting section (15).

In the sound field measuring apparatus, the time when the signal detected by the pulse signal detecting section (6, and the like) exceeds the predetermined threshold is detected. Even in the case of a speaker of slow rising, such as a subwoofer, therefore, it is possible to detect a rising portion in which the amplitude is very low. Consequently, the rising time of the output of the speaker can be correctly detected. When the threshold is adequately set, the true rising time can be detected by capturing the first response, even under circumstances where background noises or indirect sound components have a large energy.

The other sound field measuring apparatus of the invention comprises: a pulse signal generating section (11, and the like) for outputting a pulse signal to speakers (4*a*, 4*b*, . . . ); a pulse signal detecting section (6, and the like) disposed in an acoustic space (5) where the speakers (4*a*, 4*b*, . . . ) are placed and for detecting a pulse signal output from each of the speakers (4*a*, 4*b*, . . . ); a rising emphasizing section (151) for performing a process of emphasizing rising of the signal detected by the pulse signal detecting section (6, and the like); a time detecting section (152) for detecting a time when the signal obtained from the rising emphasizing section (151) exceeds a predetermined threshold; and a calculating section (153) for calculating a time period from a time when the pulse signal is generated by the pulse signal generating section (11, and the like) to a time of detection by the time detecting section (152).

In the sound field measuring apparatus, the time when the signal detected by the pulse signal detecting section (6, and the like) exceeds the predetermined threshold is detected. Even in the case of a speaker of slow rising, such as a subwoofer, therefore, it is possible to detect a rising portion in which the amplitude is very low. Consequently, the rising time of the output of the speaker can be correctly detected. When the threshold is adequately set, the true rising time can be detected by capturing the first response, even under circumstances where background noises or indirect sound components have a large energy. Furthermore, the time when the signal which has undergone the process of emphasizing rising of the signal detected by the pulse signal detecting section (6, and the like) is detected. Even in the case of a speaker of slow rising, therefore, it is possible to detect a time in the vicinity o f the rising o f the speaker.

The pulse signal output from the pulse signal generating section (11, and the like) may be a signal in which a power is concentrated into a region that is lower in frequency than an impulse signal. In this case, the S/N ratio with respect to background noises in which the level of the low frequency region is usually low can be set to be larger, and hence the rising time of the speaker can be correctly detected even under circumstances where background noises are relatively large.

The pulse signal may be a signal which attenuates with the lapse of time after rising of the pulse signal, or the pulse signal may be an exponential pulse. Alternatively, the pulse signal may be a signal which is obtained by passing an impulse signal through a low-pass filter. The pulse signal may be output by actually passing an impulse signal through a low-pass filter, or a signal which is obtained by passing an impulse signal through a low-pass filter may be stored as data, and a signal which is produced on the basis of the data may be output.

The pulse signal output from the pulse signal generating section (11, and the like) may be a signal in which a power is concentrated into a region that is lower in frequency than an impulse signal, and the rising emphasizing section (151) may perform a process of substantially flattening a frequency characteristic of the signal input into the time detecting section (152).

In this case, since the frequency characteristic of the signal which is input into the time detecting section (152) is substantially flattened, it is possible to extract the true transmission characteristic, so that measurement can be performed at the same accuracy irrespective of the band used by the speaker.

The pulse signal may be an exponential pulse, and the rising emphasizing section (151) may perform a process of applying differential of first order to the signal detected by the pulse signal detecting section (6, and the like). In this case, in the process of emphasizing the high frequency region and linearizing phase delay between bands, the computational complexity in the rising emphasizing section (151) can be suppressed to a minimum level.

The apparatus may further comprise: the signal delaying section (1) for delaying an audio output signal which is output to the speaker; and a delay time setting section (13) for setting a delay time of the the signal delaying section (1) on the basis of the time calculated by the calculating section (153). In this case, the delay time of the the signal delaying section (1) can be set to a desired delay time in accordance with the time calculated by the calculating section (153), without requiring a cumbersome work.

The sound field measuring method of the invention comprises: a pulse signal generating process of outputting a pulse signal to speakers (4*a*, 4*b*, . . . ); a pulse signal detecting process, disposed in an acoustic space where the speakers (4*a*, 4*b*, . . . ) are placed, of detecting a pulse signal output from each of the speakers (4*a*, 4*b*, . . . ); a time detecting process of detecting a time when the signal detected by the pulse signal detecting process exceeds a predetermined threshold; and a calculating process of calculating a time period from a time when the pulse signal is generated by the pulse signal generating process to a time of detection by the time detecting process.

In the sound field measuring method, the time when the signal detected by the pulse signal detecting process exceeds the predetermined threshold is detected. Even in the case of a speaker of slow rising, such as a subwoofer, therefore, it is possible to detect a rising portion in which the amplitude is very low. Consequently, the rising time of the output of the speaker can be correctly detected. When the threshold is adequately set, the true rising time can be detected by capturing the first response, even under circumstances where background noises or indirect sound components have a large energy.

The other sound field measuring method of the invention comprises: a pulse signal generating process of outputting a pulse signal to speakers (4*a*, 4*b*, . . . ); a pulse signal detecting process, disposed in an acoustic space where the speakers (4*a*, 4*b*, . . . ) are placed, of detecting a pulse signal output from each of the speakers (4*a*, 4*b*, . . . ); a rising emphasizing process of emphasizing rising of the signal detected by the pulse signal detecting process; a time detecting process of detecting a time when the signal obtained from the rising emphasizing process exceeds a predetermined threshold; and a calculating process of calculating a time period from a time when the pulse signal is generated by the pulse signal generating process to a time of detection by the time detecting process.

In the sound field measuring method, the time when the signal detected by the pulse signal detecting process exceeds the predetermined threshold is detected. Even in the case of a speaker of slow rising, such as a subwoofer, therefore, it is possible to detect a rising portion in which the amplitude is very low. Consequently, the rising time of the output of the speaker can be correctly detected. When the threshold is adequately set, the true rising time can be detected by capturing the first response, even under circumstances where background noises or indirect sound components have a large energy. Furthermore, the time when the signal which has undergone the process of emphasizing rising of the signal detected is the pulse signal detecting process is detected. Even in the case of a speaker of slow rising, therefore, it is possible to detect a time in the vicinity of the rising of the speaker.

The pulse signal output by the pulse signal generating process may be a signal in which a power is concentrated into a region that is lower in frequency than an impulse signal. In this case, the S/N ratio with respect to background noises in which the level of the low frequency region is usually low can be set to be larger, and hence the rising time of the speaker can be correctly detected even under circumstances where background noises are relatively large.

The pulse signal may be a signal which attenuates with the lapse of time after rising of the pulse signal, or the pulse signal may be an exponential pulse. Alternatively, the pulse signal may be a signal which is obtained by passing an impulse signal through a low-pass filter. The pulse signal may be output by actually passing an impulse signal through a low-pass filter, or a signal which is obtained by passing an impulse signal through a low-pass filter may be stored as data, and a signal which is produced on the basis of the data may be output.

The pulse signal output by the pulse signal generating process may be a signal in which a power is concentrated into a region that is lower in frequency than an impulse signal. The rising emphasizing process may perform a process of substantially flattening a frequency characteristic of the signal which is to be processed by the time detecting process.

In this case, since the frequency characteristic of the signal which is to be processed by the time detecting process is substantially flattened, it is possible to extract the true transmission characteristic, so that measurement can be performed at the same accuracy irrespective of the band used by the speaker.

The pulse signal may be an exponential pulse, and the rising emphasizing process may perform a process of applying differential of first order to the signal detected by the pulse signal detecting process. In this case, in the process of emphasizing the high frequency region and linearizing phase delay between bands, the computational complexity in the rising emphasizing process can be suppressed to a minimum level.

The method may further comprises: a signal delaying process of delaying an audio output signal which is output to the speaker (4*a*, 4*b*, . . . ); and a delay time setting process of setting a delay time of the signal delaying process on the basis of the time calculated by the calculating process. In this case, the delay time of the signal delaying process can be set to a desired delay time in accordance with the time calculated by the calculating process, without requiring a cumbersome work.

In order to facilitate understanding of the invention, the reference numerals used in the accompanying drawings are added in the parentheses. However, it is to be understood that the addition of the reference numerals is not intended as restriction of the invention to illustrated embodiments.

BRIEF DESCRIPTION OF THE DRAWINGS

FIG. 2 is a view showing processes of the sound field measuring apparatus.

DETAILED DESCRIPTION OF THE PRESENT INVENTION

Hereinafter, an embodiment of the sound field measuring apparatus of the invention will be described with reference to FIGS. 1 to 5.

Figure 1:
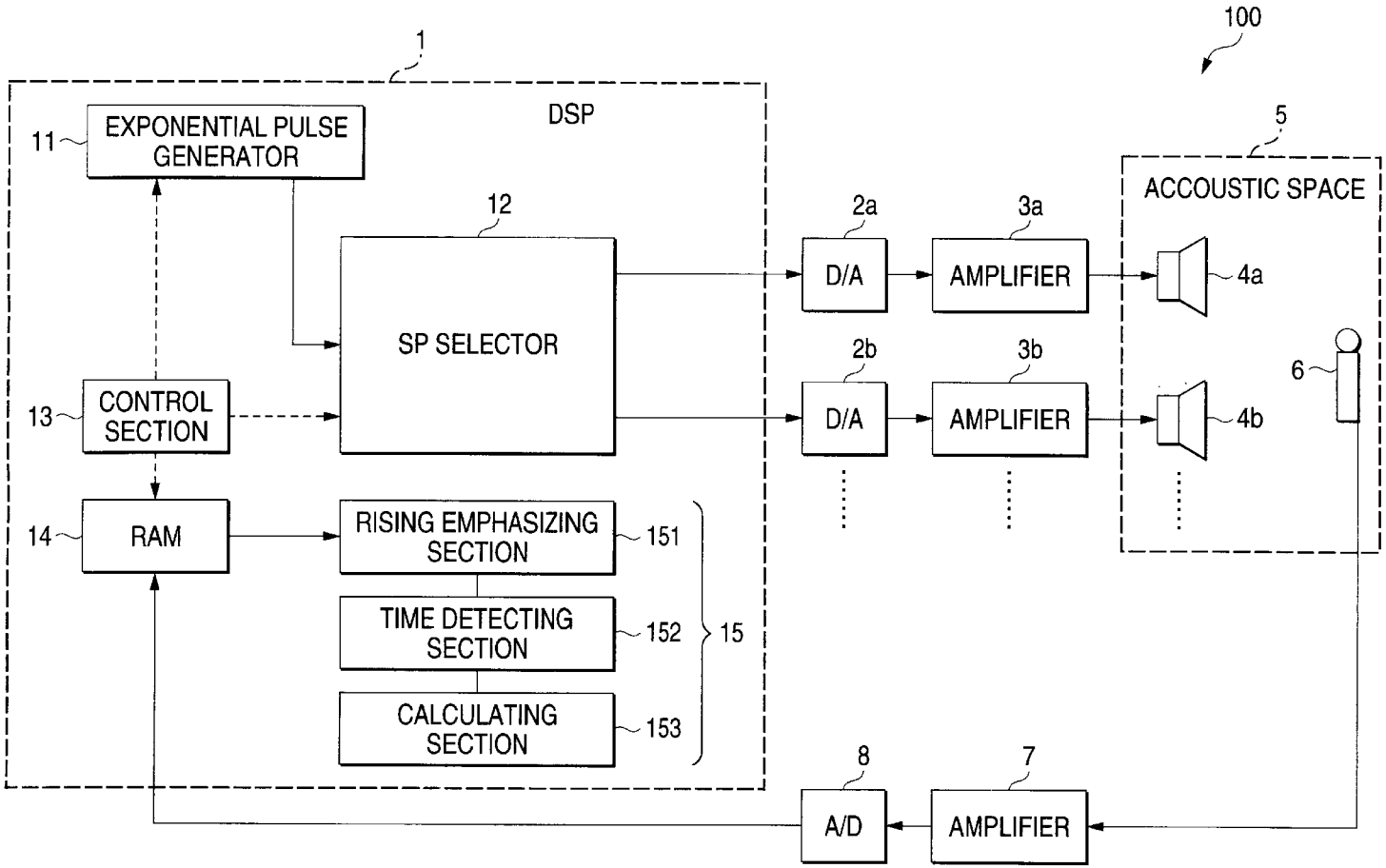
FIG. 1 is a diagram showing the configuration of a measurement system including a sound field measuring apparatus of an embodiment.

FIG. 1 is a diagram showing the configuration of a measurement system including the sound field measuring apparatus of the embodiment.

The measurement system 100 comprises: a DSP (Digital Signal Processor) 1; D/A converters 2*a*, 2*b*, . . . which receive a signal from the DSP 1; amplifiers 3*a*, 3*b*, . . . which receive signals output from the D/A converters 2*a*, 2*b*, . . . ; speakers 4*a*, 4*b*, . . . into which signals output from the amplifiers 3*a*, 3*b*, . . . are input; a microphone 6 which is disposed at a predetermined position (listening position) in an acoustic space 5 where the speakers 4*a*, 4*b*, . . . are placed; an amplifier 7 which amplifies a signal output from the microphone 6; and an A/D converter 8 which receives a signal output from the amplifier 7.

The DSP 1 comprises: an exponential pulse generator 11; a speaker selector 12; a RAM 14 for storing a received signal (for capturing a signal); a calculation section 15 for, from data stored in the RAM 14, calculating the time of arrival of an exponential pulse which is transmitted via the speaker 4*a* or 4*b*; and a control section 13 for operating the exponential pulse generator 11 and the RAM 14 so as to synchronize the start timings. The calculation section 15 comprises a rising emphasizing section 151, a time detecting section 152, and a calculating section 153.

Although not shown, the DSP 1 has a signal processing circuit which, during multichannel audio reproduction using the speakers 4*a*, 4*b*, . . . , delays a signal of each channel by a predetermined time period. According to this configuration, the distances between the speakers and the listening position can be equivalently made constant.

Figure 2A:
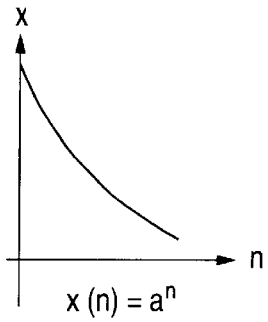
FIG. 2A is a view showing an exponential pulse signal.
Figure 2B:
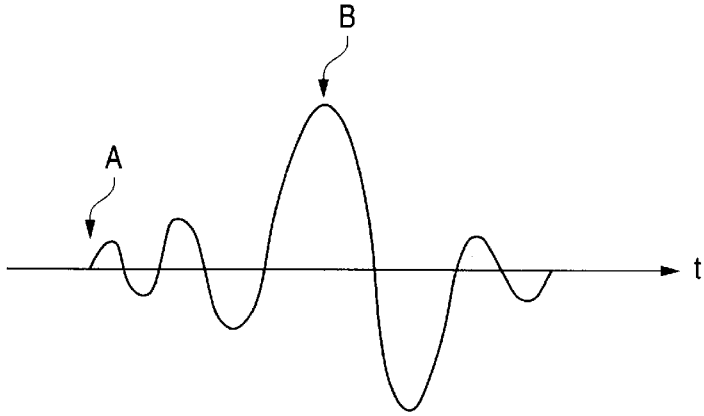
FIG. 2B is a view showing a response waveform of a speaker.
Figure 2C:
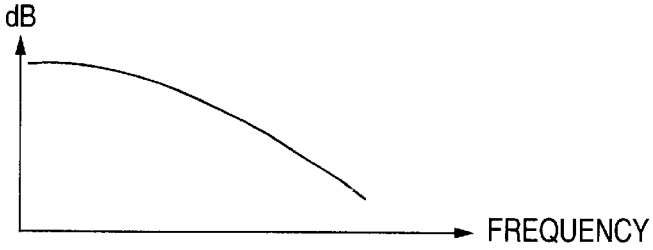
FIG. 2C is a view showing the frequency characteristic of the exponential pulse signal.

The exponential pulse generator 11 generates an exponential pulse signal such as shown in FIG. 2A. The exponential pulse signal la is a signal which has spectral components that uniformly attenuate as moving from the low frequency region to the high frequency region, and in which the energy is concentrated into the vicinity of time 0 in the time axis. The exponential pulse signal is a signal in which the rising start time is clear. As shown in FIG. 2C, in an exponential pulse, the power is more concentrated into the low frequency region than the high frequency region. Therefore, the frequency distribution of a pulse reproduced by a speaker approximates to that of background noises in which spectra are concentrated into the low frequency region. Consequently, it is possible to obtain a high S/N ratio even in an environment where the background noise level is relatively high.

Next, a procedure of correcting time alignment by using the sound field measuring apparatus of the embodiment will be described with reference to FIGS. 3 and 4. The procedure described below is implemented under the control of the control section 13.

Figure 3:
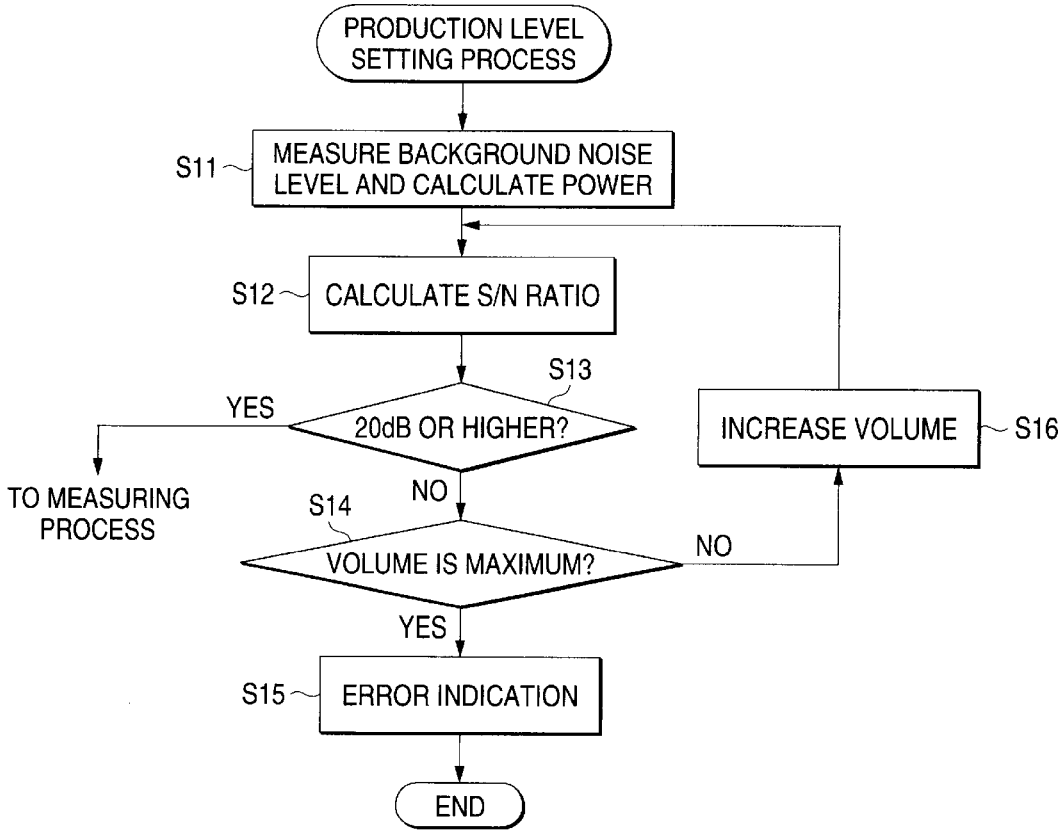
FIG. 3 is a flowchart showing a process of setting a reproduction level of the exponential pulse signal.

FIG. 3 is a flowchart showing a process of setting the reproduction level of the exponential pulse signal. When a level ratio of the exponential pulse signal to background noises is not higher than a predetermined level, the measurement system does not correctly operate. In practice, the reproduction level of the exponential pulse signal must be set so that the S/N ratio is 20 to 30 dB or higher. A predetermined S/N ratio is ensured by the process procedure of FIG. 3. An example in which the reproduction level is so that the S/N ratio is 20 dB or higher will be described.

In step S11 of FIG. 3, background noises are first captured under a state where all channels of the system are muted by instructions from the control section 13, i.e., the outputs of the speakers 4*a*, 4*b*, . . . are muted, and the calculation section 15 calculates the power. The calculated power is set as N. In step S12, the volume of the system (the output level of the speaker selector 12) is set to a predetermined position, one of the speakers is selected as a speaker which is to be measured, an exponential pulse is output from the selected speaker to capture sound field data, and the calculation section 15 calculates the power. The other speakers are muted. The value obtained by the power calculation is set as S, and the S/N ratio is then calculated. The background noises and the sound field data are introduced into the RAM 14 via the microphone 6, the amplifier 7, and the A/D converter 8.

Next, a judging process is performed in step S13. If the S/N ratio calculated in step S12 is 20 dB or higher, the control proceeds to a measuring process while maintaining the volume to the predetermined position. If the S/N ratio is lower than 20 dB, it is judged in step S14 whether the volume is at the maximum position or not. If it is judged that the volume is at the maximum position, it is deemed that abnormality has occurred, and an error indication is performed (step S15). The process is then ended. If it is judged that the volume is not at the maximum position, the volume is increased by a predetermined amount (step S16), and the control returns to step S12 to repeat the capturing of the sound field data and the calculation of the S/N ratio.

Figure 4:
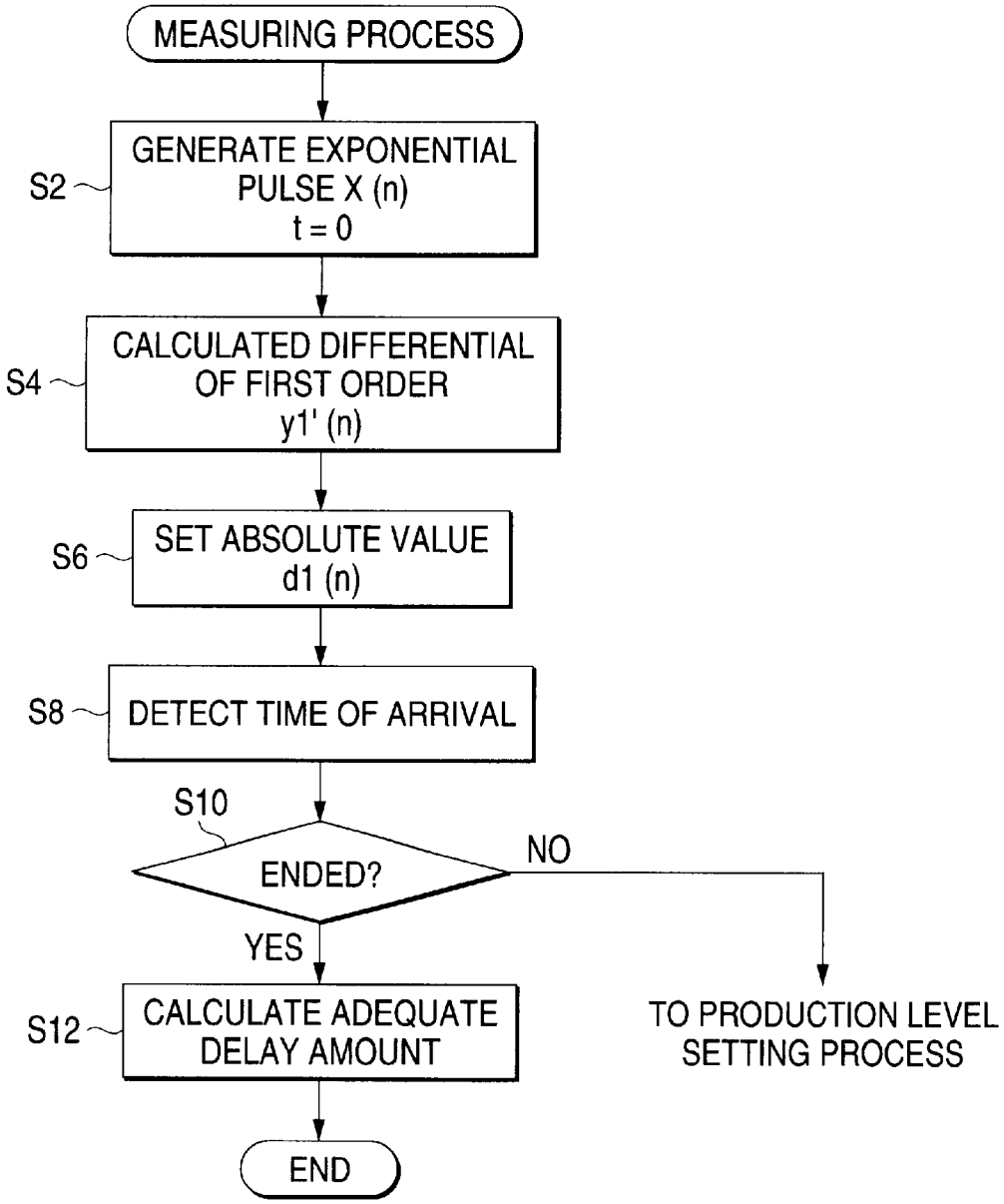
FIG. 4 is a flowchart showing a measuring process.

FIG. 4 is a flowchart showing the measuring process of detecting the time of arrival and calculating an adequate delay amount. An example will be described in which, in the measuring process, the adequate delay amount is calculated so that the times of arrival from all the speakers are equal to one another.

First, the exponential pulse generator 11 generates the exponential pulse signal, and the time when the signal is generated is set as t=0. Furthermore, the capturing of the signal into the RAM 14 is started (step S2).

After an elapse of a predetermined capturing time period, a signal y1 (n) which is detected by the microphone 6 and then captured into the RAM 14 is sent to the calculation section 15 to calculate a differential coefficient of first order (step S4). Then, the absolute value d1 (n) of the differential coefficient of first order y1' (n) is taken, the maximum value is searched from the absolute values, and a value which is obtained by attenuating the maximum value by a constant amount is calculated as a threshold th1 (step S6).

As described above, an exponential pulse signal has the low-frequency emphasizing characteristic (FIG. 2C), and the captured signal y1 (n) has a frequency characteristic in which the transmission characteristics of the speakers 4*a*, 4*b*, . . . , the acoustic space 5, the microphone 6, and the like are added to the frequency characteristic shown in FIG. 2C.

Figure 2D:
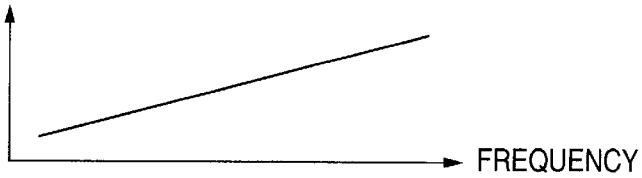
FIG. 2D is a view showing the frequency characteristic of a process of differential of first order.
Figure 2E:
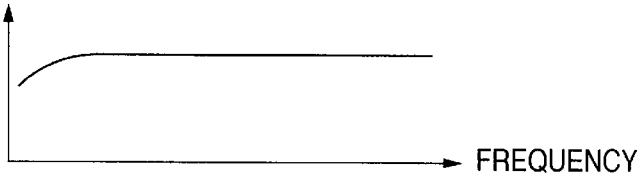
FIG. 2E is a view showing the frequency characteristic in the case where the exponential pulse signal and the differential of first order process are combined with each other.

Therefore, an output level is ensured which is sufficiently low in frequency with respect to the acoustic space that are high in low-frequency level. By contrast, as shown in FIG. 2D, the first-order differentiating process shows a high-frequency emphasizing characteristic in which the high frequency region is emphasized as compared with the low frequency region. Consequently, the low-frequency emphasizing characteristic of the exponential pulse signal and the high-frequency emphasizing characteristic of the first-order differentiating process cancel each other, so that the differential coefficient of first order y1' (n) has a frequency characteristic in which the transmission characteristics of the speakers 4*a*, 4*b*, . . . , the acoustic space 5, the microphone 6, and the like are added to a substantially flat frequency characteristic shown in FIG. 2E.

Thereafter, the minimum n which satisfies th1<d1 (n) is set as an absolute time of arrival t1 (step S8). As shown in FIG. 2B, a speaker of a heavy vibration system, such as a superwoofer shows a response characteristic in which the amplitude is not raised at once in response to an input of a pulse signal, but is gradually increased with starting from a low level. In a conventional method in which the peak of the amplitude is captured, for example, the time indicated by the arrow B in FIG. 2B is therefore detected as the rising time. By contrast, in the invention, a constant threshold is set, and a time when the absolute value of the amplitude exceeds the threshold is detected as the rising time. Moreover, the rising is previously emphasized by application of differential of first order. Therefore, the first rising of the amplitude indicated by the arrow A in FIG. 2B can be surely detected.

As a result of the above-mentioned process, the absolute time of arrival t1 of the speaker which is first selected is measured. In step S10, it is then judged whether measurement on all the speakers is ended or not. If it is judged that measurement is ended, the control proceeds to step S12. If it is judged that measurement is not ended, the control proceeds to the reproduction level setting process for the next speaker, and then to the measuring process, so that the absolute times of arrival t2, t3, . . . are sequentially measured.

When the process of steps S2 to S8 is ended for all the speakers, the judgement of step S10 is yes, and the optimum delay amount which is applied by the DSP 1 to each of the speakers is calculated on the basis of the measured absolute times of arrival t1, t2, . . . of the speaker (step S12)

In step S12, the speaker of the longest delay time is detected, and the delay amounts of the other speakers are determined so as to correspond to the longest delay time. For example, a case of two speakers will be considered. If t1>t2, t1−t2 is set as the delay amount for the second speaker SP2. At this time, the delay amount for the first speaker SP1 is set to 0. By contrast, if t1<t2, t2−t1 is set as the delay amount for the first speaker SP1. At this time, the delay amount for the second speaker SP2 is set to 0. The delay amount for each speaker in the signal processing circuit of the DSP 1 is set in accordance with instructions from the control section 13.

In practice, when a sound filed is measured by using the sound field measuring apparatus of the embodiment, influence of noises on the measurement causes a problem. In order to accurately detect the response of each speaker, therefore, influence of noises must be reduced. This can be effectively realized by repeatedly performing plural times the capturing of the signal y1 (n) in step S2 on one speaker, and averaging the signals obtained in the capturing operations along the time axis. Usually, as the averaging operation is performed at a larger number of times, the SNR is higher so that the sound pressure level required for measurement can be lowered.

The calculation of a differential coefficient of first order in step S4 is performed in order to emphasize the rising edge of the response. With respect to a speaker which has sufficient spectral components in the high frequency region, therefore, the differential of first order process is not always necessary. Alternatively, a filter of another kind may be used. In the case where differential of first order is applied to a captured signal, however, the computational complexity can be reduced as compared with other methods.

With respect to the threshold in step S8, for example, the value which is obtained by reducing the maximum value of d1 (n) by 12 dB is set (calculated). The setting method is not restricted to this. As the value of the threshold is smaller, the rising time of a signal can be captured more correctly, but the detection is more susceptible to be influenced by noises. Therefore, the value of the threshold may be set in accordance with the circumstances such as the background noise level. In an ideal environment in which there is no noise, the value of the threshold can be substantially set to "0".

In the calculation of the adequate delay amount in the above-described method, the times of arrival from all the speakers are set so as to be equal to one another. However, it is not always necessary to set the times of arrival from all the speakers so as to be equal to one another. In the embodiment, the times of arrival from all the speakers are set so as to be equal to one another because it is usually recommended to configure a multichannel speaker system so that all speakers are separated from the listener by the same distance. Therefore, the optimum delay amount is not restricted to a value at which the equi-time of arrival is made constant. Furthermore, the invention can be applied also to, for example, a case where the delay time of reproduced sound of a surround speaker with respect to that of a main speaker is to be adjusted.

In the embodiment, an exponential pulse signal is used. The signal which is useful in the measurement is not particularly restricted to an exponential pulse signal, and may be any signal which has spectral components that uniformly attenuate as moving from the low frequency region to the high frequency region, and in which the energy is concentrated into the vicinity of time 0 and the rising start time is clear.

In the embodiment, a characteristic which is flat as a whole is obtained by the low-frequency emphasizing characteristic of an exponential pulse signal, and the high-frequency emphasizing characteristic of differential of first order. In an acoustic space, usually, different phase delays are caused depending on frequency bands. By contrast, in the embodiment, the synthetic characteristic is flattened by the signal source and the calculating process (differentiating process), and emphasis or attenuation of a specific frequency is not conducted. In the audible range, the phase characteristic is substantially linear, and phase differences between bands are negligibly small.

When a flat frequency characteristic is not obtained, a band which should arrive at the earliest timing may be attenuated, thereby producing a fear that the time of arrival is erroneously judged. By contrast, in the embodiment, the true transmission characteristic of the acoustic space can be extracted by setting the characteristics of the signal source and the calculating process to have opposite relationships, and hence it is always possible to correctly detect the time of arrival of a band which arrives at the earliest timing.

Another Embodiment

In the embodiment described above, an attenuating pulse such as an exponential pulse is used as the pulse signal. A pulse signal satisfying conditions that the energy is concentrated into the low frequency region, and that the energy is concentrated in the vicinity of a certain time along the time axis can be similarly used.

Figure 5:
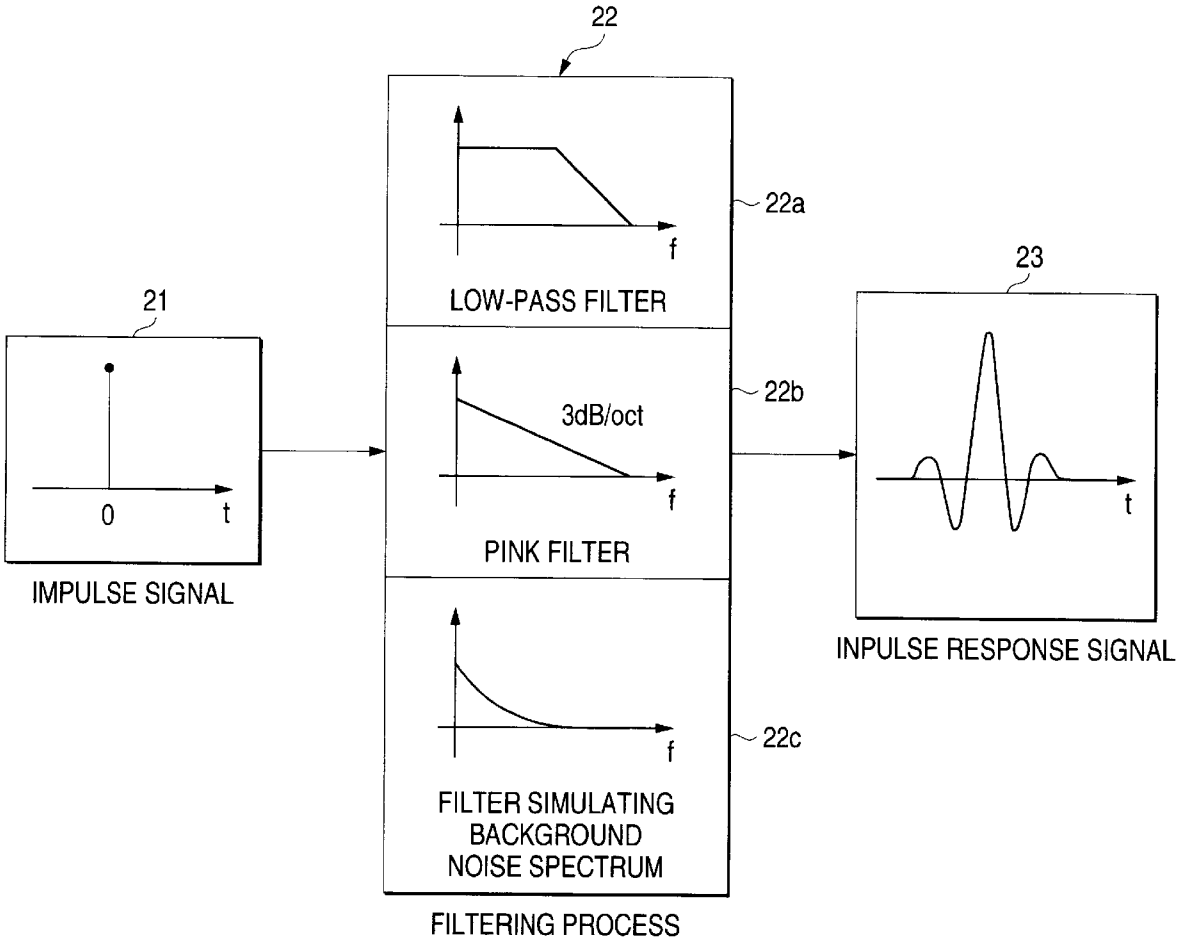
FIG. 5 is a view showing a method of producing a pulse signal from an impulse signal.

FIG. 5 shows a procedure of producing such a pulse signal. As shown in FIG. 5, an impulse response signal 23 which is obtained by performing a filtering operation using a low-frequency emphasizing filter 22, on an impulse signal 21 can be used such a pulse. As the filter 22, a low-pass filter 22*a*, a pink filter 22*b*, a filter 22*c* simulating the background noise spectrum, or the like may be used. In the graphs drawn in the filters 22*a* to 22*c*, the abscissa indicates the frequency, and the ordinate indicates the energy level. In all the filters, the low frequency region is emphasized.

Such an impulse response signal may be output by either of the following two methods. In one of the methods, the waveform of an impulse response signal is previously calculated by a computer, the calculated waveform is stored in a storage device such as a RAM of a DSP, and the stored waveform is directly output. In the other method, only filter coefficients are previously stored in a storage device, and, during a reproduction process, a signal is output while a filtering operation using the filter coefficients is performed by a DSP. The former method is suitable for a case where the storage device such as a RAM has a sufficient size and the computational complexity of the DSP is to be reduced. The latter method is suitable for a case where the size of the storage device such as a RAM is to be as small as possible although the computational complexity of the DSP may be somewhat increased.

The embodiment described above uses the opposite characteristic relationships of the exponential pulse signal and differential of first order with respect to the frequency characteristics. In the same manner, a pulse signal which is obtained by combining the impulse signal 21 with the low-frequency emphasizing filter 22 may be used. In this case, a frequency characteristic which is flat as the whole measurement system can be obtained by performing a process the characteristic of which is opposite to that of the filter 22, in place of differential of first order. Specifically, a characteristic which is opposite to that of the filter 22 is previously calculated, and a process of the opposite characteristic is applied to a signal detected by a microphone.

In the same manner as the omission of differential of first order, the process the characteristic of which is opposite to that of the filter 22 may be omitted. This process is performed in order to emphasize a rising edge of a response, and hence is not always necessary for a speaker which has sufficient spectral components in the high frequency region.

The invention is not restricted to a case where a low-frequency emphasized pulse signal is used. For example, an impulse signal is input into a speaker, and an output signal of the speaker may be detected by using a threshold. In this case, a process of emphasizing rising, i.e., that of emphasizing the high frequency region may be performed, or such a process may be omitted.

What is claimed is:

1. A sound field measuring apparatus comprising:

a pulse signal generating section for outputting a pulse signal to speakers;

a pulse signal detecting section, disposed in an acoustic space where the speakers are placed, for detecting a pulse signal output from each of the speakers;

a time detecting section for detecting a time when the signal detected by the pulse signal detecting section exceeds a predetermined threshold; and a calculating section for calculating a time period from a time when the pulse signal is generated by a pulse signal generating section to a time of detection by the time detecting section, wherein the pulse signal has spectral components that uniformly attenuate from a low frequency region to a high frequency region, and wherein an energy of the pulse signal is substantially concentrated at a predetermined time.

2. The sound field measuring apparatus according to claim 1, wherein the pulse signal output from the pulse signal generating section is a signal in which a power is concentrated into a region that is lower in frequency than an impulse signal.

3. The sound field measuring apparatus according to claim 2, wherein the pulse signal is a signal which attenuates with the lapse of time after rising of the pulse signal.

4. The sound field measuring apparatus according to claim 3, wherein the pulse signal is an exponential pulse.

5. A sound field measuring apparatus according to claim 2, wherein the pulse signal is a signal which is obtained by passing an impulse signal through a low-pass filter.

6. The sound field measuring apparatus according to claim 1, wherein the predetermined time comprises a time zero.

7. A sound field measuring apparatus comprising:

a pulse signal generating section for outputting a pulse signal to speakers;

a pulse signal detecting section, disposed in an acoustic space where the speakers are placed, for detecting a pulse signal output from each of the speakers;

a rising emphasizing section for performing a process of emphasizing rising of the signal detected by the pulse signal detecting section;

a time detecting section for detecting a time when the signal obtained from the rising emphasizing section exceeds a predetermined threshold; and a calculating section for calculating a time period from a time when the pulse signal is generated by a pulse signal generating section to a time of detection by the time detecting section, wherein the pulse signal has spectral components that uniformly attenuate from a low frequency region to a high frequency region, and wherein an energy of the pulse signal is substantially concentrated at a predetermined time.

8. The sound field measuring apparatus according to claim 7, wherein the pulse signal output from the pulse signal generating section is a signal in which a power is concentrated into a region that is lower in frequency than an impulse signal.

9. The sound field measuring apparatus according to claims 8, wherein the pulse signal is a signal which attenuates with the lapse of time after rising of the pulse signal.

10. The sound field measuring apparatus according to claim 9, wherein the pulse signal is an exponential pulse.

11. A sound field measuring apparatus according to claim 8, wherein the pulse signal is a signal which is obtained by passing an impulse signal through a low-pass filter.

12. The sound field measuring apparatus according to claim 7, wherein the pulse signal output from the pulse signal generating section is a signal in which a power is concentrated into a region that is lower in frequency than an impulse signal, and the rising emphasizing section performs a process of substantially flattening a frequency characteristic of the signal input into the time detecting section.

13. The sound field measuring apparatus according to claim 12, wherein the pulse signal is an exponential pulse, and the rising emphasizing section performs a process of applying differential of first order to the signal detected by the pulse signal detecting section.

14. The sound field measuring apparatus according to any one of claims 1 to 13, wherein the apparatus further comprises:

the signal delaying section for delaying an audio output signal which is output to the speakers; and a delay time setting section for setting a delay time of the signal delaying section on the basis of the time calculated by the calculating section.

15. The sound field measuring apparatus according to claim 7, wherein the predetermined time comprises a time zero.

16. A sound field measuring method comprising:

generating and outputting a pulse signal to speakers;

detecting a pulse signal output from each of the speakers in an acoustic space where the speakers are placed;

detecting a time when the pulse signal detected exceeds a predetermined threshold; and calculating a time period from a time when the pulse signal is generated to a time of detection, wherein the pulse signal has spectral components that uniformly attenuate from a low frequency region to a high frequency region, and wherein an energy of the pulse signal is substantially concentrated at a predetermined time.

17. The sound field measuring method according to claim 16, wherein the pulse signal output is a signal in which a power is concentrated into a region that is lower in frequency than an impulse signal.

18. The sound field measuring method according to claim 17, wherein the pulse signal is a signal which attenuates with the lapse of time after rising of the pulse signal.

19. The sound field measuring method according to claim 18, wherein the pulse signal is an exponential pulse.

20. The sound field measuring method according to claim 17, wherein the pulse signal is a signal which is obtained by passing an impulse signal through a low-pass filter.

21. The sound field measuring method according to claim 16, wherein the predetermined time comprises a time zero.

22. A sound field measuring method comprising:

generating and outputting a pulse signal to speakers;

detecting a pulse signal output from each of the speakers in an acoustic space where the speakers are placed;

emphasizing rising of the pulse signal detected;

detecting a time when the signal detected and emphasized exceeds a predetermined threshold; and calculating a time period from a time when the pulse signal is generated to a time of detection, wherein the pulse signal has spectral components that uniformly attenuate from a low frequency region to a high frequency region, and wherein an energy of the pulse signal is substantially concentrated at a predetermined time.

23. The sound field measuring method according to claim 22, wherein the pulse signal output is a signal in which a power is concentrated into a region that is lower in frequency than an impulse signal.

24. The sound field measuring method according to claim 23, wherein the pulse signal is a signal which attenuates with the lapse of time after rising of the pulse signal.

25. The sound field measuring method according to claim 24, wherein the pulse signal is an exponential pulse.

26. The sound field measuring method according to claim 23, wherein the pulse signal is a signal which is obtained by passing an impulse signal through a low-pass filter.

27. A sound field measuring method according to claim 22, wherein the pulse signal output is a signal in which a power is concentrated into a region that is lower in frequency than an impulse signal, and the rising emphasizing step performs a process of substantially flattening a frequency characteristic of the signal which is to be processed by the time detecting step.

28. A sound field measuring method according to claim 27, wherein the pulse signal is an exponential pulse, and the rising emphasizing step performs a process of applying differential of first order to the signal detected by the pulse signal detecting step.

29. A sound field measuring method according to any one of claims 16–28, wherein the method further comprises:

delaying an audio output signal which is output to the speakers; and setting a delay time of the signal delaying process on the basis of the time calculated by the calculating step.

30. The sound field measuring method according to claim 22, wherein the predetermined time comprises a time zero.

31. A sound field measuring apparatus comprising:

a pulse signal generating section for outputting a pulse signal to speakers;

a pulse signal detecting section, disposed in an acoustic space where the speakers are placed, for detecting a pulse signal output from each of the speakers;

a rising emphasizing section for performing a process of emphasizing rising of the signal detected by the pulse signal detecting section;

a time detecting section for detecting a time when the signal obtained from the rising emphasizing section exceeds a predetermined threshold; and a calculating section for calculating a time period from a time when the pulse signal is generated by a pulse signal generating section to a time of detection by the time detecting section, wherein the pulse signal output from the pulse signal generating section is a signal in which a power is concentrated into a region that is lower in frequency than an impulse signal, and the rising emphasizing section performs a process of substantially flattening a frequency characteristic of the signal input into the time detecting section.

32. The sound field measuring apparatus according to claim 31, wherein the pulse signal is an exponential pulse, and the rising emphasizing section performs a process of applying differential of first order to the signal detected by the pulse signal detecting section.

33. The sound field measuring apparatus according to claim 31, wherein the apparatus further comprises:

the signal delaying section for delaying an audio output signal which is output to the speakers; and a delay time setting section for setting a delay time of the signal delaying section on the basis of the time calculated by the calculating section.

34. The sound field measuring apparatus according to claim 32, wherein the apparatus further comprises:

the signal delaying section for delaying an audio output signal which is output to the speakers; and a delay time setting section for setting a delay time of the signal delaying section on the basis of the time calculated by the calculating section.

35. A sound field measuring method comprising:

generating and outputting a pulse signal to speakers;

detecting a pulse signal output from each of the speakers in an acoustic space where the speakers are placed;

emphasizing rising of the pulse signal detected;

detecting a time when the signal detected and emphasized exceeds a predetermined threshold; and calculating a time period from a time when the pulse signal is generated to a time of detection, wherein the pulse signal output is a signal in which a power is concentrated into a region that is lower in frequency than an impulse signal, and the rising emphasizing step performs a process of substantially flattening a frequency characteristic of the signal which is to be processed by the time detecting step.

36. A sound field measuring method according to claim 35, wherein the pulse signal is an exponential pulse, and the rising emphasizing step performs a process of applying differential of first order to the signal detected by the pulse signal detecting step.

37. A sound field measuring method according to claim 35, wherein the method further comprises:

delaying an audio output signal which is output to the speakers; and setting a delay time of the signal delaying process on the basis of the time calculated by the calculating step.

38. A sound field measuring method according to claim 36, wherein the method further comprises:

delaying an audio output signal which is output to the speakers; and setting a delay time of the signal delaying process on the basis of the time calculated by the calculating step.

* * * * *